US008713751B2

(12) United States Patent
Conrad

(10) Patent No.: US 8,713,751 B2
(45) Date of Patent: May 6, 2014

(54) SURFACE CLEANING APPARATUS WITH LINER BAG

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 921 days.

(21) Appl. No.: 11/953,381

(22) Filed: Dec. 10, 2007

(65) Prior Publication Data

US 2008/0196745 A1 Aug. 21, 2008

Related U.S. Application Data

(60) Provisional application No. 60/894,005, filed on Mar. 9, 2007, provisional application No. 60/869,586, filed on Dec. 12, 2006.

(51) Int. Cl.
*A47L 9/10* (2006.01)
*A47L 9/20* (2006.01)

(52) U.S. Cl.
USPC ..... 15/352; 134/21

(58) Field of Classification Search
USPC ..... 134/104.2, 56 R, 58 R
See application file for complete search history.

(56) References Cited

U.S. PATENT DOCUMENTS

| | | | | |
|---|---|---|---|---|
| 3,755,992 | A | 9/1973 | Ylinen | |
| 3,910,781 | A | 10/1975 | Bryant, Jr. | |
| 4,523,936 | A | 6/1985 | Disanza, Jr. | |
| 4,838,907 | A * | 6/1989 | Perry | 55/381 |
| 5,090,976 | A | 2/1992 | Dyson | |
| 5,129,125 | A * | 7/1992 | Gamou et al. | 15/352 |
| 5,145,499 | A | 9/1992 | Dyson | |
| 6,018,843 | A | 2/2000 | Disanza | |
| 6,178,590 | B1 | 1/2001 | Lindsay, III et al. | |
| 6,579,334 | B2 * | 6/2003 | Oh et al. | 55/426 |
| 6,596,047 | B2 * | 7/2003 | Oh | 55/426 |
| 7,065,826 | B1 | 6/2006 | Arnold | |
| 7,080,425 | B2 | 7/2006 | Smith et al. | |
| 7,140,068 | B1 | 11/2006 | Vander Baan et al. | |
| 2004/0172782 | A1 * | 9/2004 | Smith et al. | 15/314 |

FOREIGN PATENT DOCUMENTS

EP 0489468 A1 11/1991

OTHER PUBLICATIONS

International Preliminary Report on Patentability received on the corresponding international application No. PCT/CA2007/002217, mailed on Jun. 19, 2009.
European Search Report received on the corresponding European application No. 07855499.5, mailed on May 27, 2010.

* cited by examiner

*Primary Examiner* — Michael Barr
*Assistant Examiner* — Jason Ko
(74) *Attorney, Agent, or Firm* — Bereskin & Parr LLP/S.E.N.C.R.L., s.r.l.; Philip C. Mendes da Costa

(57) ABSTRACT

A surface cleaning apparatus is disclosed. In some embodiments, the surface cleaning apparatus comprises a member having a dirty fluid inlet. A fluid flow path extends from the dirty fluid inlet to a clean air outlet of the surface cleaning apparatus and includes a suction motor. At least one cyclone is positioned in the fluid flow path and has at least one material outlet and a divider plate associated with the material outlet. A material collection chamber is in flow communication with the at least one cyclone. The apparatus further comprises a liner bag retaining member.

21 Claims, 13 Drawing Sheets

SURFACE CLEANING APPARATUS WITH LINER BAG

CROSS REFERENCES TO RELATED APPLICATIONS

This application claims priority from U.S. Provisional applications 60/894,005 (filed on Mar. 9, 2007), and 60/869,586 (filed on Dec. 12, 2006), all of which are incorporated herein by reference in their entirety.

FIELD OF THE INVENTION

The invention relates to surface cleaning apparatuses such as vacuum cleaners, wet/dry vacuum cleaner and carpet extractors. More specifically, the invention relates to surface cleaning apparatus, which comprise a chamber having a removable liner.

BACKGROUND OF THE INVENTION

Various types of vacuum cleaners are known in the art. Traditionally, vacuum cleaners have utilized a filtration bag. Accordingly, the dirty air, which was drawn into the vacuum cleaner, was conveyed into a porous bag. As the air traveled through the bag, the entrained dirt was separated from the air stream. More recently, cyclonic vacuum cleaners have been developed. Cyclonic vacuum cleaners may be used to collect particulate matter (i.e. dirt). Cyclonic vacuum cleaners are advantageous, as they do not utilize a filter bag that must be replaced. Rather, cyclonic vacuum cleaners use a chamber, which collects dirt or fluid removed from the air stream. As the chamber fills, it must be emptied by a user. Accordingly, the chamber, or the entire vacuum cleaner, may be transported to a position above a receptacle (e.g. a garbage bin or a drain) and opened so as to allow the dirt or fluid to pour into the receptacle. In the case of particulate matter, when the particulate matter is poured into the receptacle, captured particulate matter may be released into the surrounding environment. In the case of fluid, when the fluid is poured into a drain, spills may occur.

SUMMARY OF THE INVENTION

In one broad aspect, a surface cleaning apparatus is provided wherein the apparatus includes at least one cyclone having an associated collection chamber wherein a divider plate is positioned at the juncture or passage between the cyclone chamber and the collection chamber and a liner is removably placed in the collection chamber. The surface cleaning apparatus may be configured to collect particulate matter, or liquids.

Accordingly, the surface cleaning apparatus comprises a member having a dirty fluid inlet. A fluid flow path extends from the dirty fluid inlet to a clean air outlet of the surface cleaning apparatus, and includes a suction motor. At least one cyclone is positioned in the fluid flow path and has at least one material outlet and a divider plate associated with the material outlet. A material collection chamber is in flow communication with the at least one cyclone. The surface cleaning apparatus further comprises a liner bag-retaining member. The liner bag-retaining member removably secures a disposable or reusable liner in the material collection chamber.

Embodiments in accordance with this broad aspect may be advantageous because a liner bag may be retained in the material collection chamber and collect separated material that may then be disposed of by opening the material collection chamber (e.g., by opening a door or removing the material collection chamber from the surface cleaning apparatus) and removing the liner bag. With the use of a diver plate, the cyclone may achieve a high separation of fines, which will collect in the liner bag. The liner bag may be removed and disposed of (e.g., in a garbage can) without pouring or dumping the fines into a garbage can, thereby avoiding substantially disturbing the already quiescent fines, which might otherwise have to then be recollected.

Additionally, when a user wishes to empty the material collection chamber, the user may remove the liner bag from the material collection chamber, and may transport the liner bag to a receptacle, without being required to transport the entire collection chamber or entire apparatus to the receptacle. Furthermore, the user may seal the liner bag, such that particulate or liquid matter is not released or spilled into the surrounding environment during such transport.

In some embodiments, the divider plate is mounted to a top wall of the material collection chamber.

In some embodiments, divider plate is mounted to an upper portion of a sidewall of the material collection chamber. Such embodiments may be advantageous because the liner bag may be easily placed in and removed from the material collection chamber, without having to move or manipulate the divider plate.

In some embodiments, the material collection chamber is positioned below the material outlet.

In some embodiments, the divider plate is positioned in the material outlet.

In some embodiments the surface cleaning apparatus comprises a vacuum line having one end in fluid flow communication with a space positioned between an inner surface of the material collection chamber and the other end with the fluid flow path at a location upstream of the suction motor, preferably immediately upstream of the suction motor (e.g., just upstream of a pre-motor filter or between an optional pre-motor filter and the suction motor). Such embodiments may be advantageous because the vacuum line may provide a force, which holds the liner bag in position in the material collection chamber. It will be appreciated that the vacuum line may communicate with the interior of the material collection chamber at two or more locations. It will also be appreciated that this positioning of the vacuum line may be used in any embodiment of a surface cleaning apparatus using a liner bag, regardless of if a divider plate is used.

In some embodiments, the material collection chamber is moveable relative to the at least one cyclone.

In some embodiments, the material collection chamber is removable from the at least one cyclone.

In another broad aspect, a surface cleaning apparatus is provided. The surface cleaning apparatus comprises a member having a dirty fluid inlet. A fluid flow path extends from the dirty fluid inlet to a clean air outlet of the surface cleaning apparatus and includes a suction motor. At least one cyclone is positioned in the fluid flow path and has at least one material outlet and a divider plate associated with the material outlet. A material collection chamber is in flow communication with the at least one cyclone. A liner bag is removably positionable in the material collection chamber.

In some embodiments, the divider plate is mounted to a top wall of the material collection chamber.

In some embodiments, the divider plate is mounted to an upper portion of a sidewall of the material collection chamber.

In some embodiments, the material collection chamber is positioned below the material outlet.

In some embodiments, the divider plate is positioned in the material outlet.

In some embodiments, the surface cleaning apparatus comprises a vacuum line having one end in fluid flow communication with a space positioned between an inner surface of the material collection chamber and the other end with the fluid flow path at a location upstream of the suction motor.

In some embodiments, the material collection chamber is moveable relative to the at least one cyclone.

In some embodiments, the material collection chamber is removable from the at least one cyclone.

In another broad aspect, a method is provided for cleaning a surface using a surface cleaning apparatus. The method comprises:

(a) placing a liner in a material collection chamber;

(b) operating the surface cleaning apparatus comprising:

i. passing a member having a dirty fluid inlet over a surface;

ii. conveying a fluid from the dirty fluid inlet to a cyclone separator having a material outlet and conveying material from the cyclone separator past a divider plate to the liner positioned in the material collection chamber;

iii. collecting material inside the liner positioned in the material collection chamber; and, (c) discontinuing operation of the surface cleaning apparatus.

In some embodiments, the divider plate is associated with the material outlet of the cyclone chamber and the method further comprises opening at least a portion of the material collection chamber and removing the liner.

In some embodiments, the divider plate is associated with the material outlet of the cyclone chamber and the method further comprises removing at least a portion of the material collection chamber from the surface cleaning apparatus and removing the liner.

In some embodiments, the divider plate is positioned in the material collection chamber below the material outlet of the cyclone chamber and the method further comprises removing at least a portion of the material collection chamber from the surface cleaning apparatus and removing the liner while retaining the divider plate with the surface cleaning apparatus.

In some embodiments, the method further comprises disposing of a used liner.

BRIEF DESCRIPTION OF THE DRAWINGS

These and other advantages of the present invention will be more fully and particularly understood in connection with the following description of the preferred embodiments of the invention in which.

DETAILED DESCRIPTION OF THE INVENTION

Figure 1:
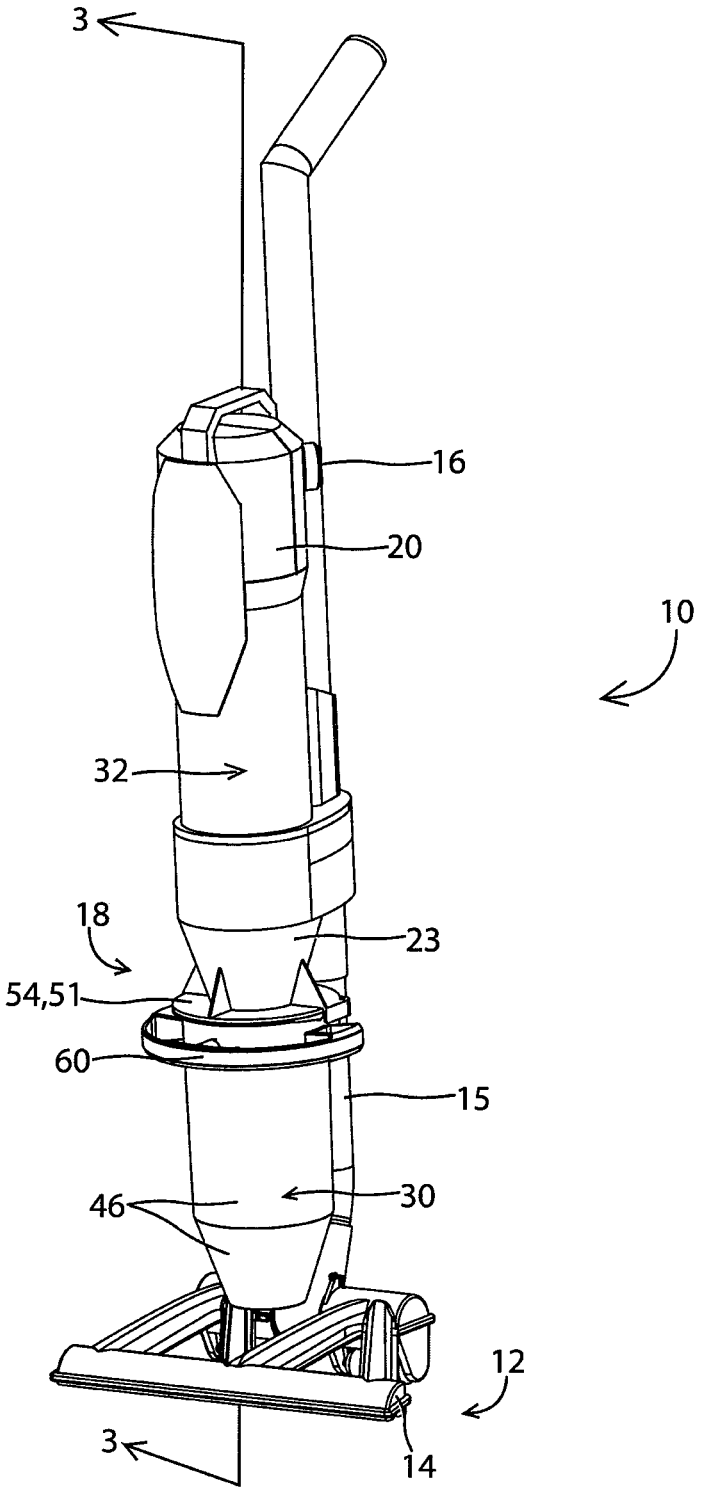
FIG. 1 is a perspective illustration of an embodiment of a surface cleaning apparatus of the present invention.
Figure 2:
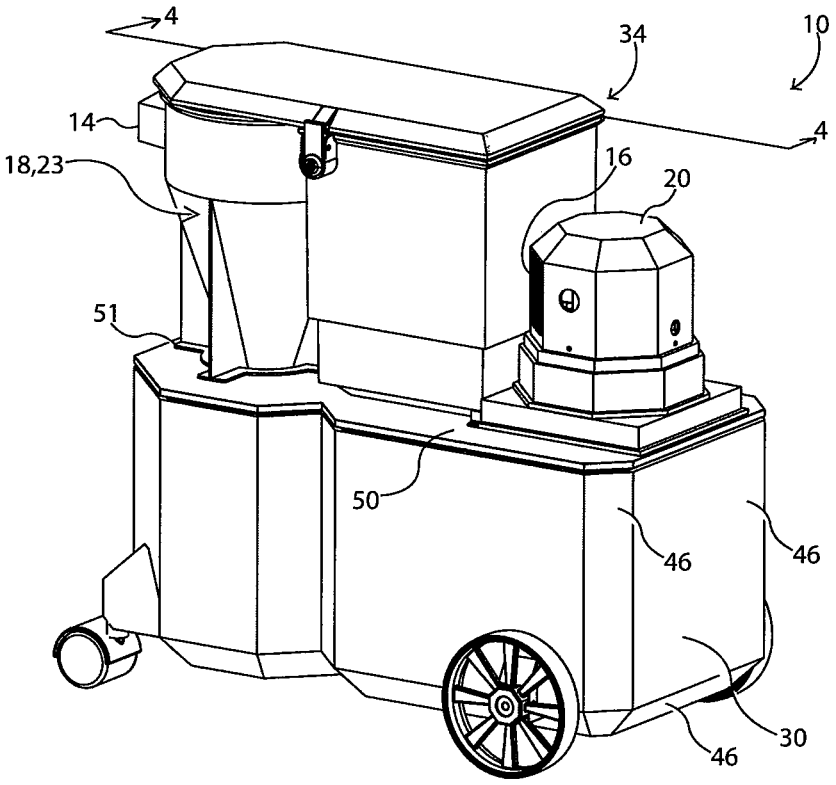
FIG. 2 is a perspective illustration of another embodiment of a surface cleaning apparatus of the present invention.

Embodiments of a surface cleaning apparatus 10 of the present invention are shown in FIGS. 1 and 2. In some embodiments, the surface cleaning apparatus 10 may be configured to collect particulate matter. For example, as shown in FIG. 1, the surface cleaning apparatus 10 may be an upright vacuum cleaner. In other embodiments, the surface cleaning apparatus 10 may be another type of surface cleaning apparatus which collects particulate matter, for example a hand vacuum cleaner, a canister type vacuum cleaner, a stick vacuum cleaner, a back pack vacuum cleaner, a carpet extractor or the like. Alternatively, the surface cleaning apparatus 10 may be configured to collect liquids. For example, as shown in FIG. 2, surface cleaning apparatus 10 may be a shop-vac or wet/dry type vacuum cleaner.

The surface cleaning apparatus 10 comprises a member 12 having dirty fluid inlet 14. The fluid passing through the dirty fluid inlet may be air entrained with dirt, or may be air and liquid. In the embodiment of FIG. 1, member 12 is a surface cleaning head. In the embodiment of FIG. 2, as is known in the art, a hose or wand having a distal inlet that may be mounted on a surface cleaning head may be attached to inlet 12. In other embodiments member 12 may be another member having a dirty fluid inlet. A fluid flow path extends from the dirty fluid inlet 14 to a clean air outlet 16. At least one cyclonic cleaning stage 18 is provided in the fluid flow path for removing particulate matter from air, or for removing liquid from air. A fluid flow motor 20 is positioned in the fluid flow path for drawing fluid from the dirty fluid inlet 14 to the clean fluid outlet 16.

Figure 3A:
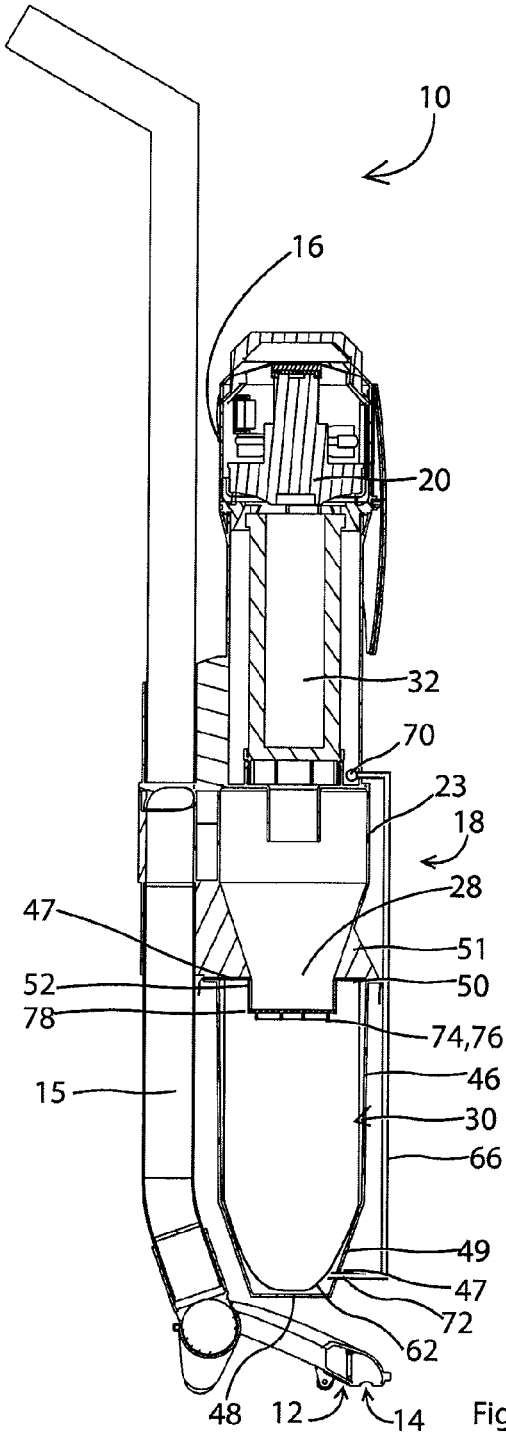
FIG. 3A is a cross-sectional illustration of the embodiment of FIG. 1, taken along line 3-3.
Figure 4:
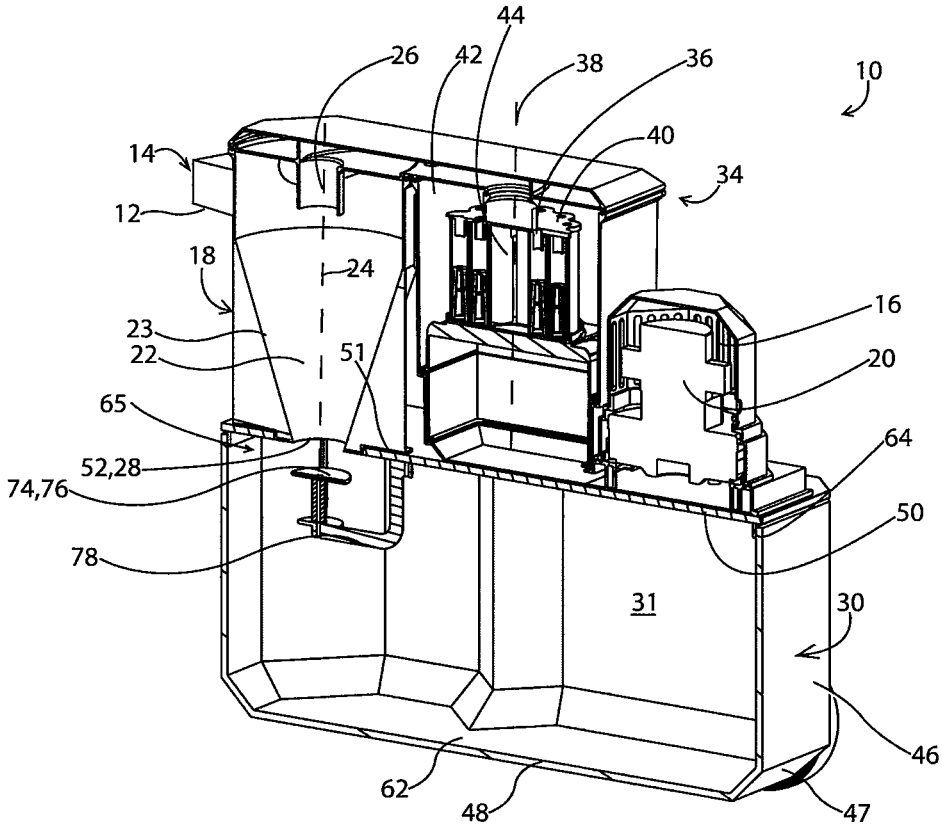
FIG. 4 is a cross sectional illustration of the embodiment of FIG. 2, taken along line 4-4.

Referring to FIGS. 3A and 4, dirty fluid entering dirty fluid inlet 14 is directed to cyclonic cleaning stage 18. In the embodiment of FIG. 3A, a conduit 15 is provided between dirty fluid inlet 14 and cyclonic cleaning stage 18. In the embodiments shown, cyclonic cleaning stage 18 comprises a single cyclone chamber 22 defined in a cyclone 23, which extends longitudinally along a first longitudinal axis 24. In other embodiments, cyclonic cleaning stage 18 may comprise a plurality of cyclones. Cyclone 23 comprises a clean air outlet 26, and a material outlet 28. A material collection chamber 30, as will be described further hereinbelow, is positioned below dirt outlet 28.

In some embodiments, air exiting cyclone chamber 22 may be directed past motor 20, and out of clean fluid outlet 16. Alternatively, air exiting cyclone chamber 22 may be directed to one or more additional cleaning stages, such as another component, for example housing a filter 32, prior to flowing past motor 20, and out of clean fluid outlet 16, as shown in FIG. 3A. In another embodiment, as shown in FIG. 4, air exiting cyclone chamber 22 through clean air outlet 26 is directed to a second cleaning stage 34, past motor 20, and out of clean fluid outlet 16. In the embodiment shown, the second cleaning stage 34 comprises a plurality of second cyclones 36 in parallel.

The second cleaning stage 34 has, in the example exemplified, a generally cylindrical configuration with a second longitudinal axis 38. The second axis 38 is parallel to, and laterally offset from, first axis 24. Each of the second cyclones 36 in the assembly receives air from the clean air outlet 26 of the first cyclone, and discharges air through outlets 40 into a manifold 42. Air is evacuated from the manifold 42 through a conduit 44 disposed centrally of the assembly. From the conduit 44 the air is drawn towards the motor 20, and expelled from the apparatus 10 through clean air outlet 16. In addition, in some embodiments the additional cleaning stage 34 may include a filter element, such as a pre-motor foam membrane, disposed in the fluid stream between the cleaning stage 34 and the motor 20.

As previously mentioned, a material collection chamber 30 (referred to hereinafter as chamber 30) is positioned below cyclone 23. Chamber 30 collects material discharged from dirt outlet 28 of cyclone 23. The discharged material may comprise fluid and/or particulate matter for example. Chamber 30 comprises at least one wall defining a cavity 31 and may be of any configuration.

Figure 3B:
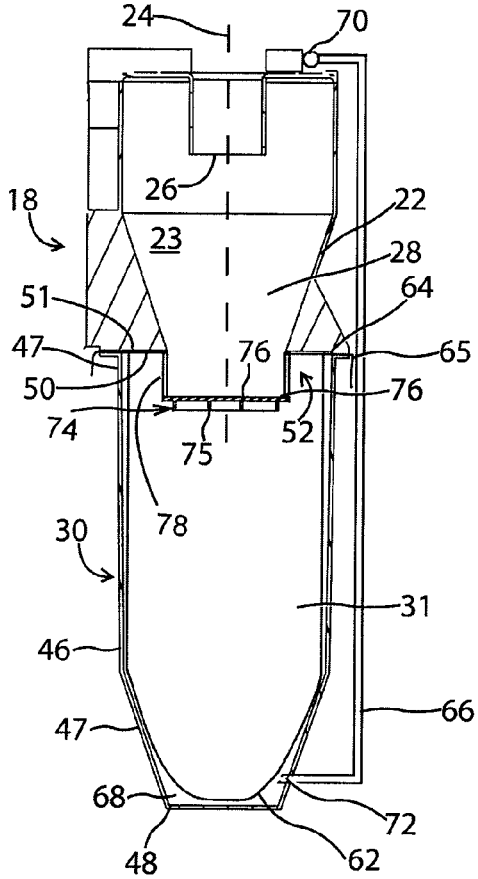
FIG. 3B is a close-up view of the material collection chamber shown in FIG. 3A.

For example, in the embodiment of FIGS. 3A and 3B, chamber 30 comprises a cylindrical upper sidewall 46, a frustoconical lower side wall 47, a bottom wall 48, and a top wall 50. Top wall 50 is provided by a lower surface 51 that may be a flange surrounding cyclone 22, which abuts the upper end 47 of upper sidewall 46.

Figure 5A:
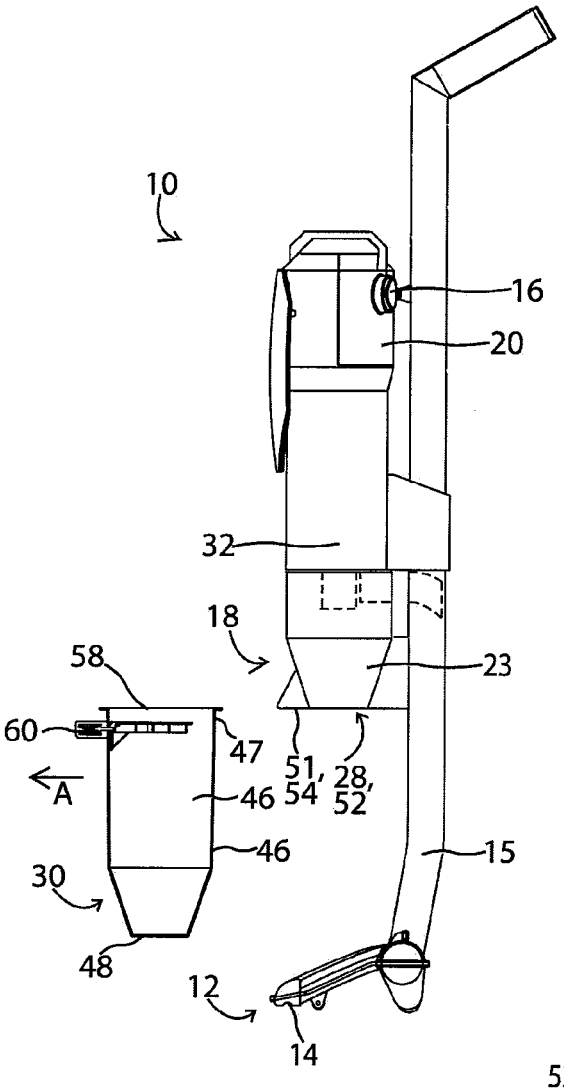
FIG. 5A is a side view of the embodiment of FIG. 1, showing a cavity of a material collection chamber in an accessible position.
Figure 5B:
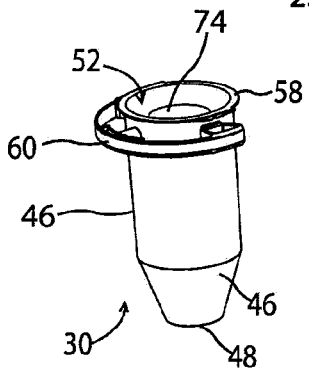
FIG. 5B is a perspective illustration of the embodiment of FIG. 1, showing a cavity of a material collection chamber in an accessible position.
Figure 5B:
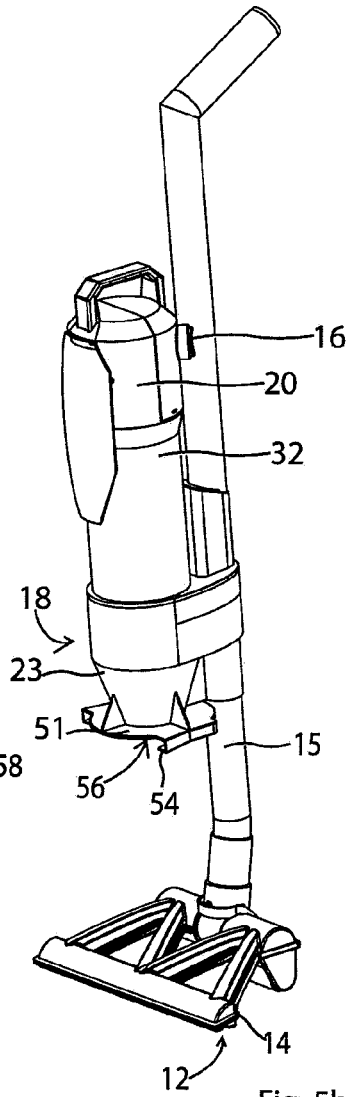
Figure 6:
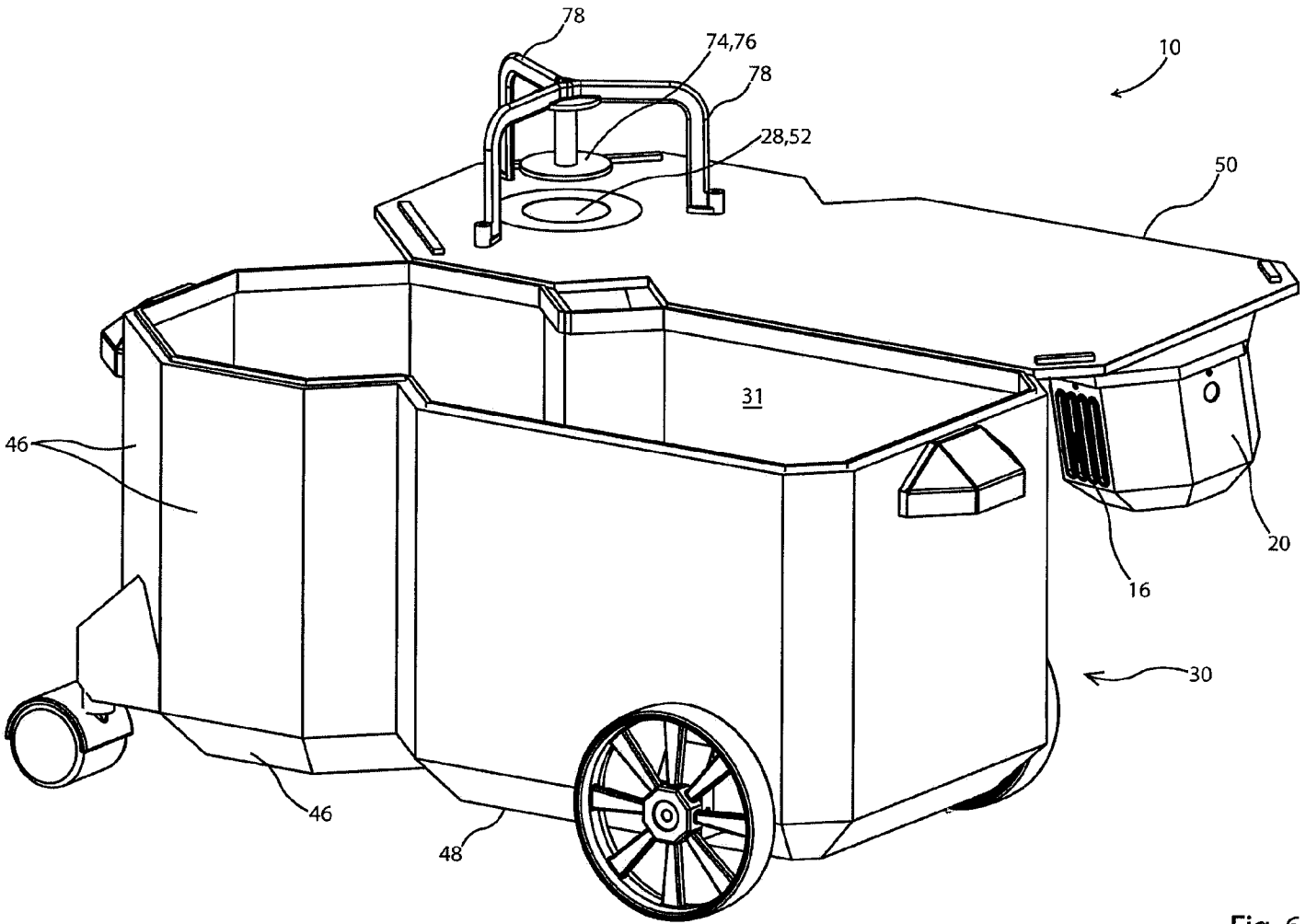
FIG. 6 is a perspective illustration of the embodiment of FIG. 2, showing a cavity of a material collection chamber in an accessible position.

Alternately, in the embodiment of FIG. 4, chamber 30 comprises a plurality of upper side walls 46 which meet at an angle, a plurality of optional lower side walls 47 which meet at an angle, a bottom wall 48, and a top wall 50. Chamber 30 further comprises at least one material inlet 52 in fluid communication with material outlet 28. In the embodiments shown, material inlet 52 is defined in top wall 50. In some embodiments, material outlet 28 and material inlet 52 may coincide. In other embodiments, material outlet 28 and material inlet 52 may be separate, and a conduit may be provided for providing fluid communication therebetween Cavity 31 of chamber 30 is accessible, such that the liner may be emptied. For example, in the embodiment shown in FIGS. 5A and 5B, chamber 30 is movable relative to cyclone 22, and removable therefrom, such that cavity 31 may be accessed. That is, flange 51 is provided with C-channels 54, which define a slot 56 for slidably receiving a rim 58 provided on side walls 46. Additionally, chamber 30 is provided with a handle 60. Accordingly, in order to remove chamber 30, a user may grasp handle 60 and slide chamber 30 away from cyclone chamber 22 in the direction of arrow A. In the embodiment of FIG. 6, chamber 30 is openable, such that cavity 31 may be accessed. That is top wall 50 of chamber 30 may be pivoted away from chamber 30 such that chamber 30 may be opened. In other embodiments, cavity 31 may be accessible in another manner. For example, a door may be provided for removing the liner, chamber 30 may be pivotally mounted to the cyclone or another portion of the surface cleaning apparatus. In any such embodiments, chamber 30 may optionally be provided with a gasket or other sealing member for sealing chamber 30 to cyclone chamber 23 when cavity 31 is not in an accessible position.

Surface cleaning apparatus 10 also includes a divider plate 74 associated with, and preferably positioned adjacent the material outlet 28 of the cyclone chamber 23. Divider plate may be any plate known in the art that is positionable between a cyclone outlet and a dirt collection chamber.

Figure 7:
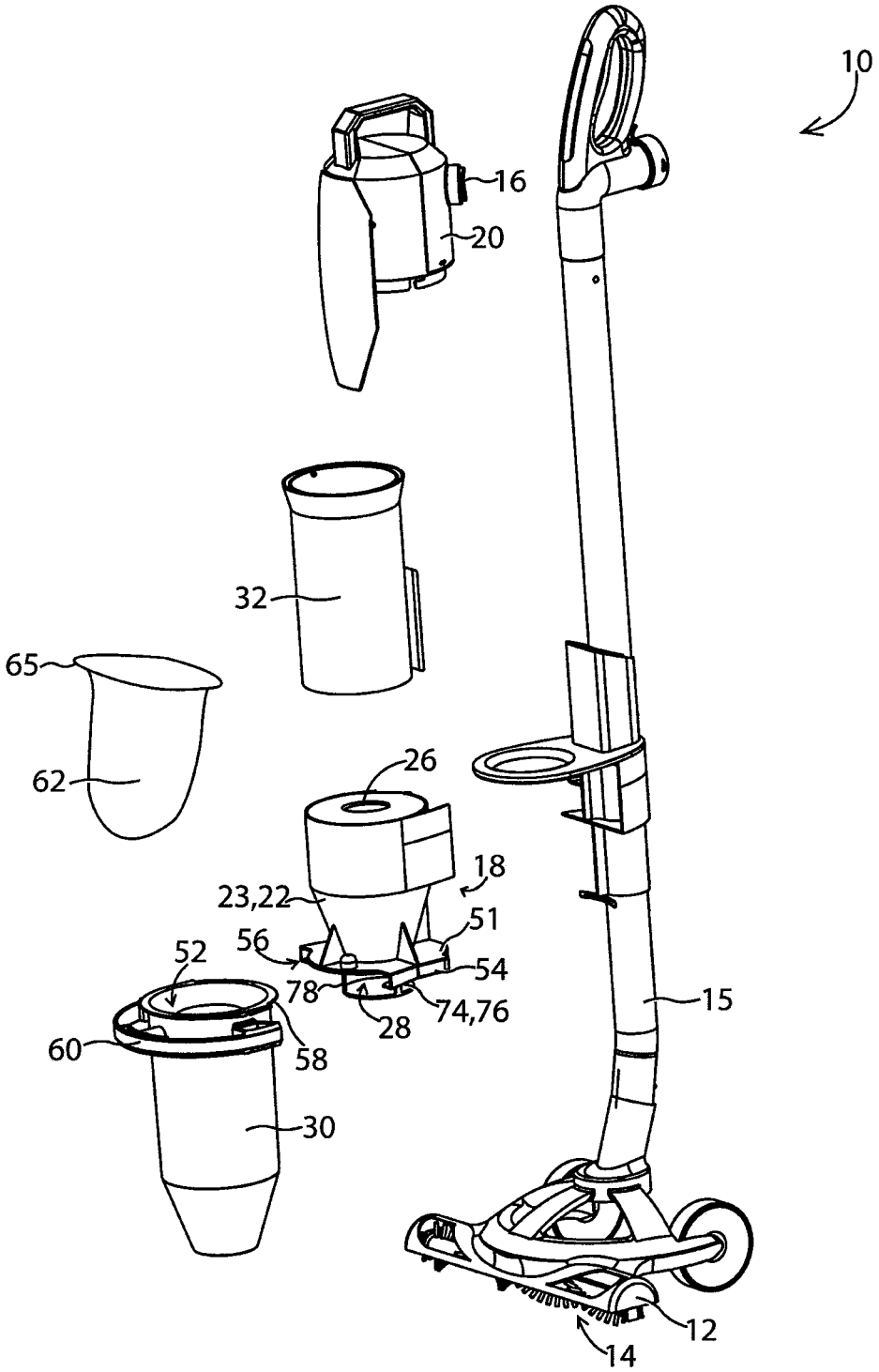
FIG. 7 is an exploded view of the embodiment of FIGS. 5A and 5B with a different surface cleaning head.
Figure 8A:
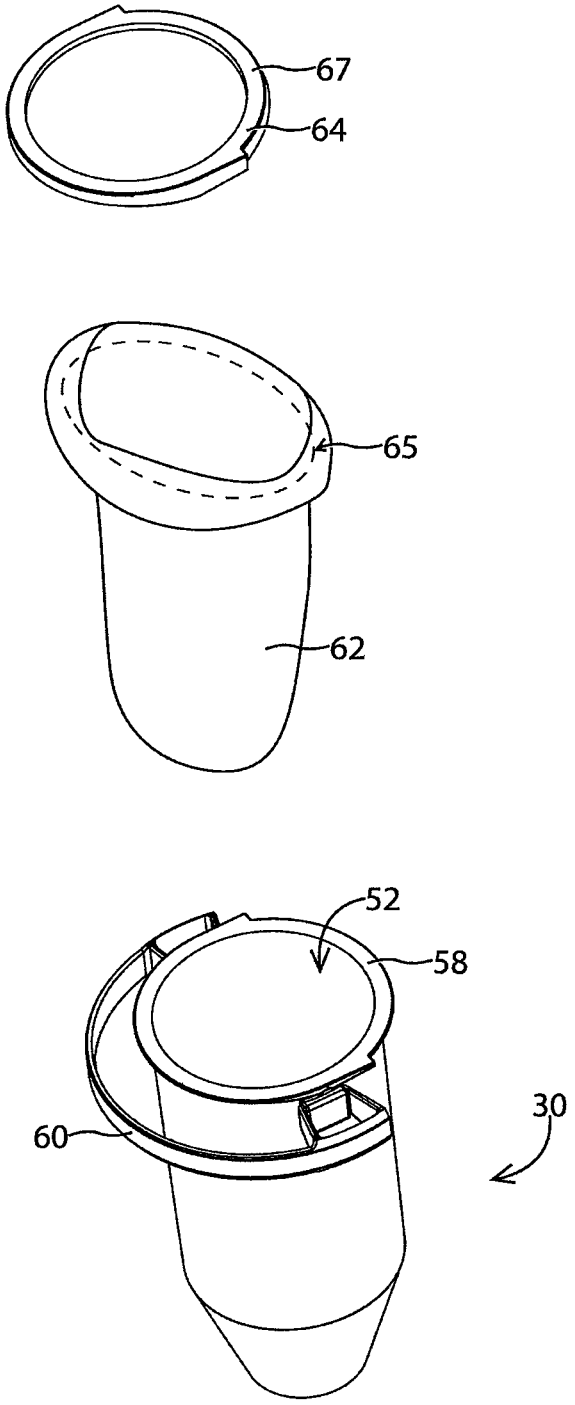
FIG. 8A is a perspective view of an embodiment of a material collection chamber of the present invention in a disassembled configuration, showing a liner bag and a liner bag retaining member.
Figure 8B:
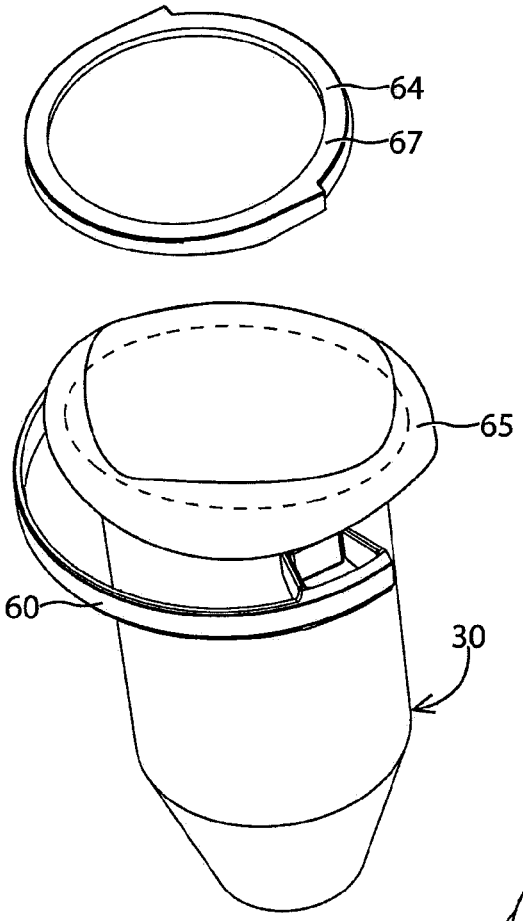
FIG. 8B is a perspective view of the embodiment of FIG. 8A, in a partially assembled configuration.
Figure 8C:
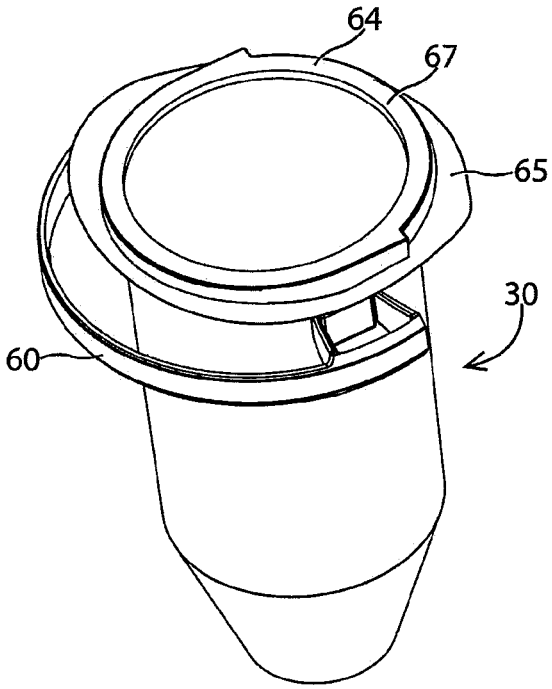
FIG. 8C is a perspective view of the embodiment of FIG. 8A, in an assembled configuration.
Figure 9A:
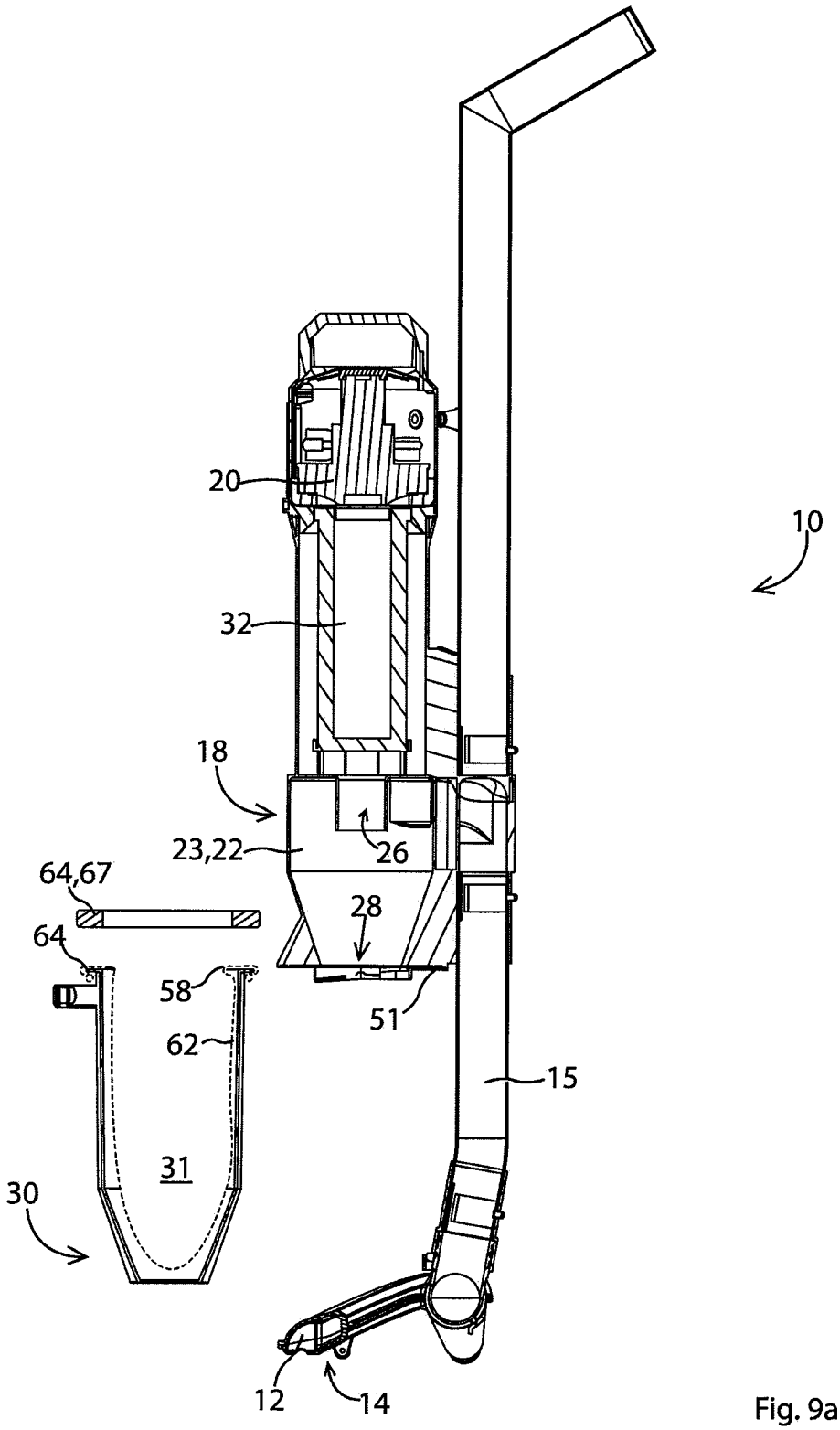
FIGS. 9A-9B are cross sections taken along line 3-3 in FIG. 1, showing a material collection chamber and the liner bag retainer member of FIGS. 8A-8C removed from a surface cleaning apparatus.
Figure 9B:
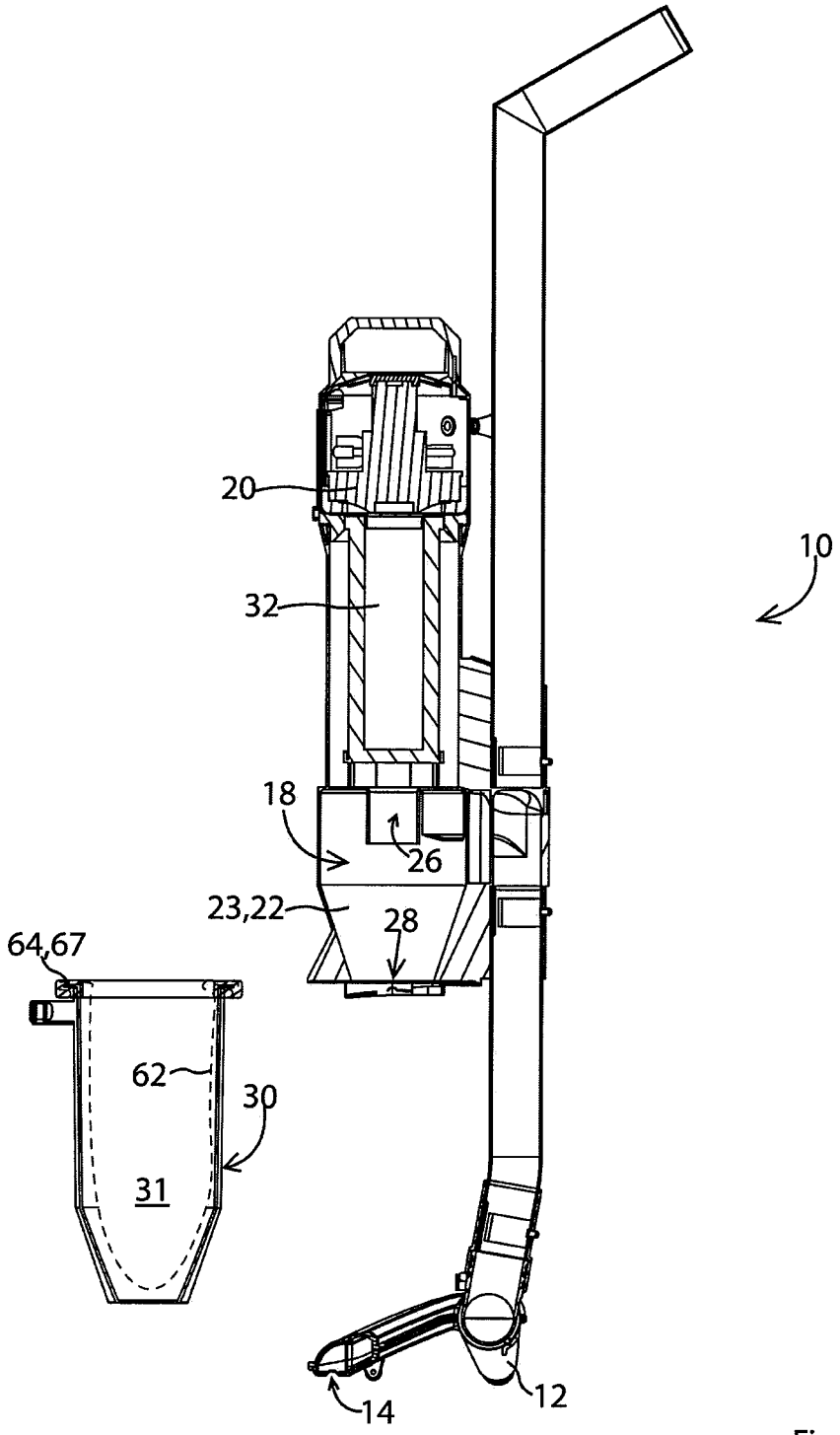

In the example illustrated in FIGS. 3A and 3B, the divider plate 74 is positioned within the chamber 30, adjacent to but spaced below the material outlet 28. The divider plate 74 may generally comprises a disc 76 having reinforcing ribs 75 therebelow that, when positioned below the dirt outlet 28, has a diameter slightly greater than the diameter of the dirt outlet 28, and disposed in facing relation to the dirt outlet 28. The disc 76 is, in the examples illustrated, mounted to apparatus 10 by one or more supports 78. In the embodiment of FIGS. 3A and 7, supports 78 are mounted to flange 51 surrounding cyclone chamber, and extend downwardly into chamber 30 to support disc 76. In the embodiment of FIG. 4 supports 78 are mounted to top wall 50 of chamber 30, and extend downwardly into chamber 30 to support disc 76. Alternately, support(s) 78 may be mounted to a sidewall 46 of chamber 30. In other embodiments, divider plate 74 may be positioned within material outlet 28. In such an embodiment, dirt chamber inlet 52 may be defined between top wall 50 and divider plate 74, and may be substantially annular.

Surface cleaning apparatus 10 is adapted to receive a liner, such as liner bag 62, for lining chamber 30. Liner bag 62 may be essentially a plastic bag, cloth bag or the like that is disposable. Referring to FIGS. 3B and 4, liner bag 62 may extend along the inner surface 49 of chamber 30 at side walls 46 and bottom wall 48, and may be dimensioned to sit against inner walls 49 of chamber 30 (e.g., it is of the same size and shape). Liner bag 30 may aid a user in emptying chamber 30, as will be described further hereinbelow. It will be appreciated that liner bag need not be configured to rest against all of the sidewalls and bottom wall of chamber 30, which is preferred, but may be of a different shape.

Figure 10A:
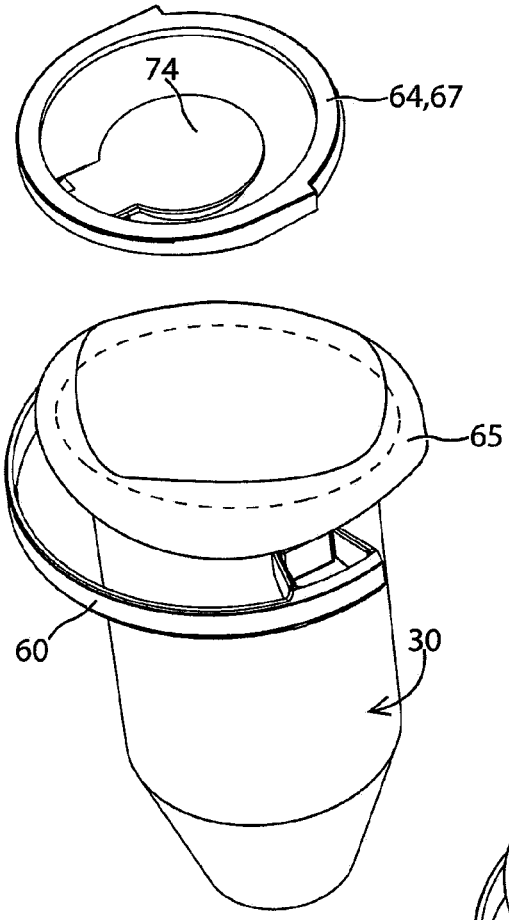
FIG. 10A is a perspective view of an embodiment of a material collection chamber of the present invention in a disassembled configuration, showing a liner bag and an alternate liner bag retaining member.
Figure 10B:
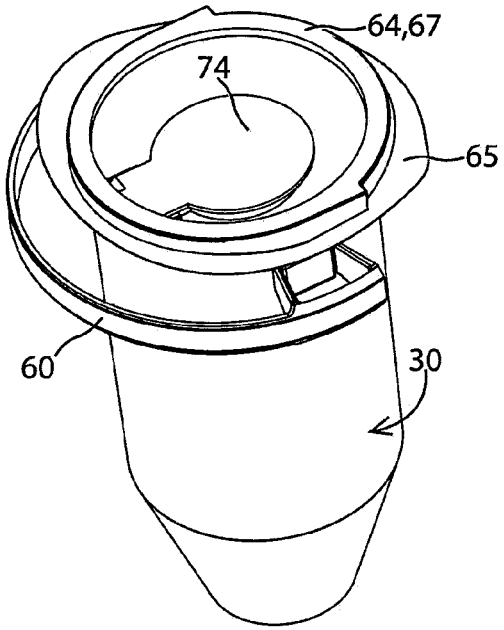
FIG. 10B is a perspective view of the material collection chamber of FIG. 10A, in an assembled configuration; and, FIGS. 11A-11B are cross sections taken along line 3-3 in FIG. 1, showing a material collection chamber and the liner bag retainer member of FIGS. 10A-10B removed from a surface cleaning apparatus.
Figure 11A:
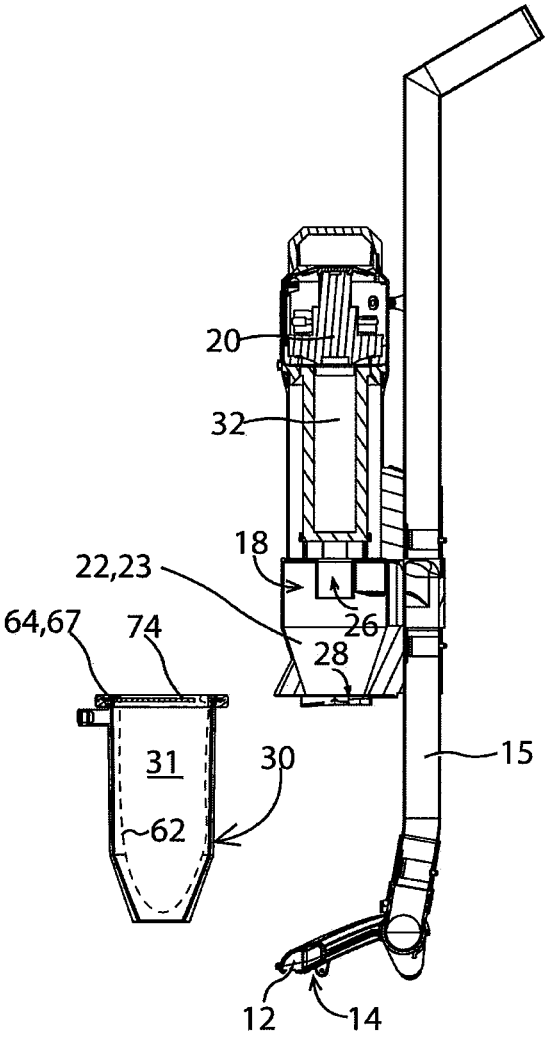
Figure 11B:
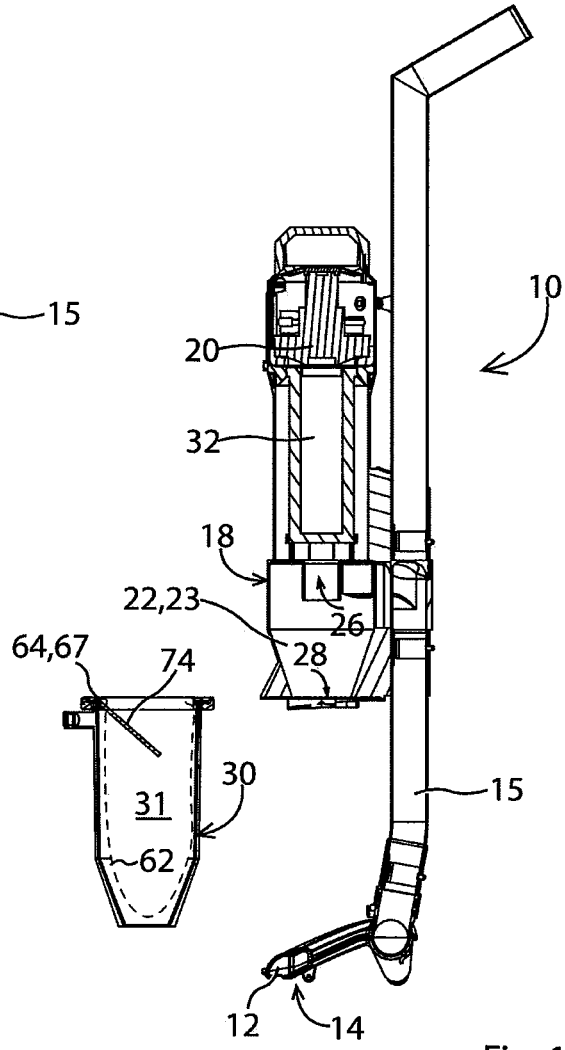

Surface cleaning apparatus 10 may further comprise a liner bag retaining member 64, for holding a portion of liner bag 62 in place within chamber 30. In the embodiment of FIG. 3B, liner bag retaining member 64 comprises rim 60 and C-channel 56 (see FIG. 5B), between which an upper portion 65 of liner bag 62 is pinched, and secured in place. In the embodiment of FIG. 4, liner bag retaining member 64 comprises an upper portion of sidewalls 46, and a perimeter of top wall 50, between which an upper portion 65 of liner bag 62 is pinched and secured in place. In the embodiment shown in FIGS. 8A-8C, and 10A-10B, liner bag retaining member comprises a collar 67, which is placed on rim 60 on top of upper portion 65 of liner bag 62, to secure upper portion 65 in place. Collar 67 and/or rim 60 may then be slid into C-channel 56 together with material collection chamber 30. Collar 67 may be secured thereto such as by a snap fit, a magnet, a releasable adhesive, mechanical securing members such as a latch, clips, a set screw or the like. In some embodiments, as shown in FIGS. 10A-10B, divider plate 74 may be mounted to collar 67. In such an embodiment, divider plate 74 may be movable with respect to collar 67, such that a user may empty material collection chamber 30, without removing collar 67 or liner bag 62, as shown in FIG. 11B. In other embodiments, liner bag retaining member 64 may comprise other members. For example, chamber 30 may be provided with one or more of clips, hooks, or an adhesive on inner wall 49 and/or on an outer surface of liner bag 62 for securing liner bag 62 in place.

In some embodiments, the suction provided by motor 20 may be used to aid in maintaining liner bag 62 in place. For example, referring to FIG. 3B, the pressure at the upper portion of cyclone chamber 22 (i.e. adjacent the cyclone inlet) will be lower than the pressure in chamber 30. Accordingly, in order to assist in maintaining liner bag 62 adjacent inner surface 49 of chamber 30, one or more vacuum lines 66 may be provided. In the embodiment shown, vacuum line 66 extends from cyclone chamber 22 to interstitial cavity 68, which is defined as the space between liner bag 62 and the inner wall 49 of chamber 30. Preferably, the outlet 70 of vacuum line 66 is positioned proximate the inlet (or as part of the inlet) of cyclone chamber 22. Preferably, the inlet end 72 of vacuum line 66 is provided in a plurality of positions, preferably adjacent bottom wall 48 of chamber 30. The flow of air from inlet end 72 to outlet end 70 will assist in securing liner bag 62 in position. It will be appreciated that a liner bag may be used with any of the aspects of the vacuum.

In use, a user may access cavity 31 of chamber 30 by opening chamber 30, or by removing chamber 30 from apparatus 10. The user may then place liner bag 62 in chamber 30, and return chamber 30 to an operational position. The divider plate may extend from an upper portion of the chamber 30. Accordingly, the user may place liner bag 62 in chamber 30 such that it extends along inner surface 49 at sidewalls 46 and bottom wall 49, without interference from the divider plate. The user may then operate apparatus 10 by engaging motor 20 and passing member 12 over a surface. As member 12 is passed over the surface, fluid will be conveyed from dirty fluid inlet 14 into cyclone 23, past divider plate 74, and into liner 62 positioned in chamber 30. As the apparatus is operated, material will collect in liner 62. When the operation of the apparatus 10 is discontinued, the user may again access cavity 31 of chamber 30 and remove liner 62 from chamber 30, (instead of carrying chamber 30 to a receptacle or after carrying chamber 30 to the receptacle). The user may then optionally gather the upper portion 65 of liner bag 62, and seal liner bag 62, for example by tying a knot in upper portion 65. The user may then dispose of liner bag 62, and optionally place a new liner bag in chamber 30.

It will be appreciated that certain features of the invention, which are, for clarity, described in the context of separate embodiments or separate aspects, may also be provided in combination in a single embodiment. Conversely, various features of the invention, which are, for brevity, described in the context of a single embodiment or aspect, may also be provided separately or in any suitable sub-combination.

Although the invention has been described in conjunction with specific embodiments thereof, if is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention.

I claim:

1. A surface cleaning apparatus comprising:

(a) a member having a dirty fluid inlet;

(b) a fluid flow path extending from the dirty fluid inlet to a clean air outlet of the surface cleaning apparatus and including a suction motor downstream from the at least one cyclone;

(c) at least one cyclone positioned in the fluid flow path and having a longitudinally extending axis;

(d) a material collection chamber comprising a wall with an opening, the opening comprising a cyclone material outlet;

(e) a divider plate positioned in the material collection chamber, the divider plate spaced from and facing the material outlet, a direction of the longitudinally extending axis; and, (f) a liner bag securable in the material collection chamber.

2. The surface cleaning apparatus of claim 1 further comprising a liner bag provided in the material collection chamber.

3. The surface cleaning apparatus of claim 1 wherein the divider plate is mounted by a support member to the wall and is positioned in the material collection chamber.

4. The surface cleaning apparatus of claim 1 wherein the divider plate is mounted by a support member to an upper portion of a sidewall of the material collection chamber and the divider plate is positioned below an upper end of the bag when a bag is provided in the surface cleaning apparatus.

5. The surface cleaning apparatus of claim 1 wherein the material collection chamber is positioned below the material outlet.

6. The surface cleaning apparatus of claim 1 further comprising a vacuum line having one end in fluid flow communication with a space positioned between an inner surface of the material collection chamber and another end with the fluid flow path at a location upstream of the suction motor.

7. The surface cleaning apparatus of claim 1 wherein the material collection chamber is moveable relative to the at least one cyclone.

8. The surface cleaning apparatus of claim 7 wherein the material collection chamber is removable from the at least one cyclone.

9. The surface cleaning apparatus of claim 1 wherein the divider plate has an upper surface that is unobstructed.

10. The surface cleaning apparatus of claim 1 wherein the divider plate has an upper surface that is flat.

11. The surface cleaning apparatus of claim 1 wherein the divider plate is positioned below an upper end of the bag when a bag is provided in the surface cleaning apparatus.

12. A surface cleaning apparatus comprising:

(a) a member having a dirty fluid inlet;

(b) a fluid flow path extending from the dirty fluid inlet to a clean air outlet of the surface cleaning apparatus and including a suction motor downstream from the at least one cyclone;

(c) at least one cyclone positioned in the fluid flow path and having a cyclone chamber, at least one material outlet at an outlet end of the cyclone chamber, a longitudinally extending axis and, an air outlet;

(d) a material collection chamber axially spaced from the at least one cyclone, the material collection chamber having a cross sectional area in a direction transverse to the longitudinally extending axis that is larger than a cross sectional area of the outlet end of the cyclone chamber;

(e) a divider plate positioned in the material collection chamber, the divider plate spaced from the air outlet and axially spaced from and facing the material outlet and having a portion that extends across a central portion of the cyclone; and, (f) a liner bag removably positionable in the material collection chamber.

13. The surface cleaning apparatus of claim 12 wherein the divider plate is mounted by a support member to a wall of the material collection chamber adjacent the cyclone chamber.

14. The surface cleaning apparatus of claim 12 wherein the divider plate is mounted by a support member to an portion of a sidewall of the material collection chamber adjacent the cyclone chamber.

15. The surface cleaning apparatus of claim 12 wherein the material collection chamber is positioned below the material outlet.

16. The surface cleaning apparatus of claim 12 further comprising a vacuum line having one end in fluid flow communication with a space positioned between an inner surface of the material collection chamber and another end with the fluid flow path at a location upstream of the suction motor.

17. The surface cleaning apparatus of claim 12 wherein the material collection chamber is moveable relative to the at least one cyclone.

18. The surface cleaning apparatus of claim 17 wherein the material collection chamber is removable from the at least one cyclone.

19. The surface cleaning apparatus of claim 12 wherein the divider plate has an upper surface that is unobstructed.

20. The surface cleaning apparatus of claim 12 wherein the divider plate has an upper surface that is flat.

21. The surface cleaning apparatus of claim 12 wherein the divider plate is positioned below an upper end of the bag.

* * * * *